United States Patent [19]

Mario

[11] Patent Number: 4,722,450

[45] Date of Patent: Feb. 2, 1988

[54] CONTAINER CAP WITH VALVE

[75] Inventor: André Mario, Brunoy, France

[73] Assignee: Cotelle, S.A., Ivry sur Seine, France

[21] Appl. No.: 796,641

[22] Filed: Nov. 8, 1985

[30] Foreign Application Priority Data

Nov. 15, 1984 [FR] France ..... 84 17413

[51] Int. Cl.[4] ..... B65D 51/16

[52] U.S. Cl. ..... 215/260

[58] Field of Search ..... 215/260; 220/303

[56] References Cited

U.S. PATENT DOCUMENTS 2,102,157 12/1937 Keaney et al. ..... 215/260
3,114,467 12/1963 Montgomery .
3,239,091 3/1966 Driscoll .

FOREIGN PATENT DOCUMENTS 3233859 3/1984 Fed. Rep. of Germany .

*Primary Examiner*—Donald F. Norton

*Attorney, Agent, or Firm*—Brumbaugh, Graves Donohue & Raymond

[57] ABSTRACT

A sealing device for containers which forms a valve for automatic elimination of overpressurized gases that may form with the container is provided. The device is composed of a rigid cap having a flat crown and depending skirt, an elastic disk sector in contact with the underside of the flat crown and an inner cap having a circular crown with a circular cutout and raised circular rim on an upperside thereof. A flat circular protuberance on the underside surface of the disk sector, when the device is in use fits into and is surrounded by the circular crown portion, both of which are adapted to fit vertically over the orifice of the container. When in use, the circular crown exerts a crushing pressure on the upper portion of the elastic disk sector while at the same time the flat circular protuberance remains sufficiently elastic to allow gases overpressurized to vent from the container.

7 Claims, 2 Drawing Figures

CONTAINER CAP WITH VALVE

BACKGROUND OF THE INVENTION

The present invention concerns the sealing of vessels by means of a device ensuring a vent.

This invention concerns more particularly a sealing device for vessels which, when suitably positioned on the vessel to be sealed, makes it possible to avoid practically any leakage of liquid of solid materials from the vessel and also to ensure the automatic elimination of the overpressurized gases existing or formed in this same vessel.

The invention is not limited to a particular type of vessel or container or to a particular field. However, it is easiest to describe the invention and to compare it with the previous technique, by reference to a particular application such as a flask type container having a threaded neck and screwed stopper. It is clear that, as the invention does not apply to this application only, the description which follows may be transposed mutatis mutandis to other categories of containers and/or to other applications, without falling outside the scope of the invention claimed.

The invention is exemplified by the sealing of flasks which contain a cleaning product containing a hypochlorite, in particular a sodium hypochlorite having a high chlorometric degree. It is known that liquid cleaning compounds which contain hypochlorite having a high chlorimetric degree liberate gaseous oxygen during storage through the slow decomposition of the hypochlorite. If the container containing such compounds has a seal which is impervious to gases, an overpressure inside the container resulting from gas generation may take the container swell and leak.

At present, sealing systems are known which provide a valve effect, the triggering of which is automatic, starting from a more or less predetermined overpressure of gas inside the container. These systems operate through displacement by deforming a circular tightness producing part. This displacement is provided by an appropriate profile of the bottom of the plug into which this circular part is inserted. Such sealing systems have the following disadvantages:

(1) They allow not only the gas to escape from the container, but also a mixture of liquid and gas in the form of a foam which oozes and forms crystallized deposits around the sealing system.

(2) In addition, they can operate only if the tightness on the threaded neck of the container remains sufficiently loose to allow a degree of freedom of the circular tightness-producing part to subsist. The sealing system must not be too loose however, or else the liquids can leak from the container.

An unexpected solution to these problems has now been found. Other advantages are described below which are obtained by means of a simple and practical sealing device provided with a vent.

The object of the invention is a sealing device which forms a valve for the automatic elimination of overpressurized gases in a container fitted with such a device. Under normal conditions of use, this device allows practically no liquid or solid materials to leak and does not require adjustment at an incomplete stage of tightening.

This device is described in FIGS. 1 and 2 of the drawings.

Figure 1:
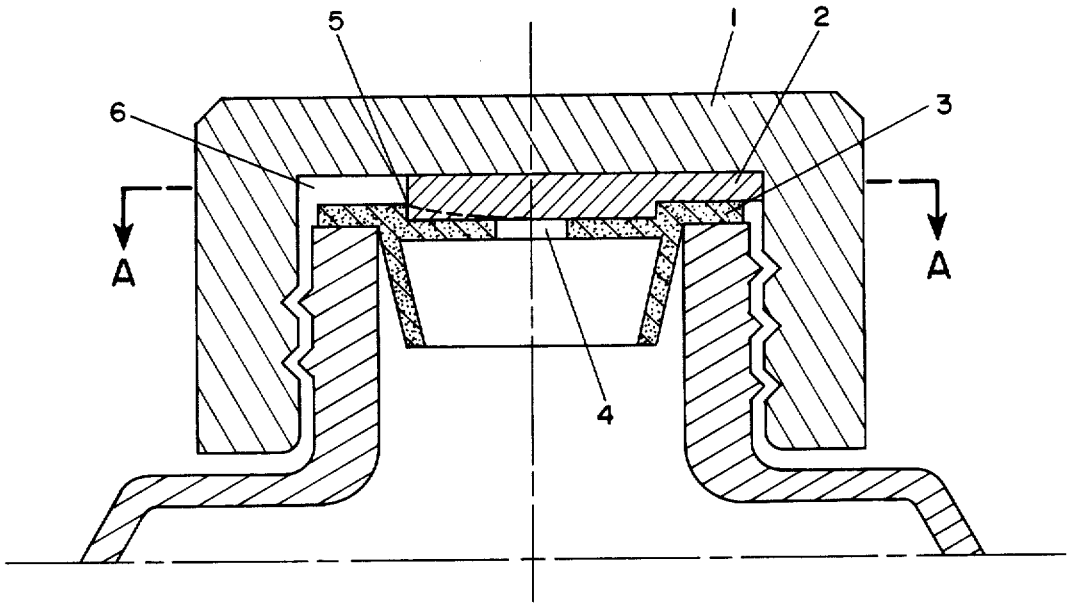
FIG. 1 shows a side view in a diagrammatic longitudinal section of the upper part of a flask with a threaded neck fitted with an embodiment of a device according to the invention.

With reference to FIG. 1, the device of the invention comprises:

(a) a seal or cap 1, having a flat crown and depending skirt, (b) a sector of a circular disk 2 composed of an elastic material, said elastic disk sector 2 having an area greater than half the area of an entire circular disk of the same diameter, a straight edge 5, an upper portion thereof in contact with the underside of the flat crown of cap 1 and, when the device is in use, a flat circular protuberant portion on the underside thereof, said protuberant portion being adjacent the straight edge and having an area less than the area of the elastic disk sector, (c) an inner cap 3 having a circular crown and depending skirt, said circular crown having a circular cut out portion therein and a raised circular rim portion, said cut out portion being adapted, when the device is in use, to intimately contact the flat circular protuberant portion of the underside of the elastic disk sector 2, such that the flat circular protuberant portion of the elastic disk sector fits into the cut out portion of the circular crown and is surrounded by the circular rim portion of the circular crown and forms a tight seal therewith, said flat circular protuberant portion of the elastic disk sector and said cut out portion of the circular crown being adpated to be placed vertically over a neck of a container, and said circular crown, which, when the device is in use, exerts a crushing pressure on the elastic disk sector, thereby causing the upper portion of the elastic disk sector to lose elasticity and become pressed against the flat crown whereas, at the same time, the flat circular protuberant portion on the underside of the elastic disk sector which fits into the cut out portion of the circular crown and is surrounded by the raised circular rim portion of the circular crown remains sufficiently elastic to be able to subside to allow the release of excess gas built up in the container, and then reform a tight seal with the raised circular rim portion of the circular crown.

According to another embodiment, the circular crown portion may be formed directly by the raised circular crown of the orifice, such as the neck of the container. The device encompassed by this second embodiment thus comprises two components: the cap having a flat crown and depending skirt and the elastic circular disk sector.

In a variation of the embodiment depicted in FIG. 1, the inner cap 3 may ensure, in a classical manner, a reduction in the diameter of the orifice of the container when the depending skirt of the inner cap is forcefully inserted into the orifice. In this variation the top portion of e circular crown of inner cap 3 has a raised zone on the edge of its upper face. When the device is in a position sealing the orifice of the container, a crushing pressure is exerted on upper portion of the elastic disk sector in contact with this raised portion of the circular crown of inner cap 3, while the flat circular protuberant portion on the underside of the elastic disk sector 2 situated inside the circular crown behaves as indicated above.

Figure 2:
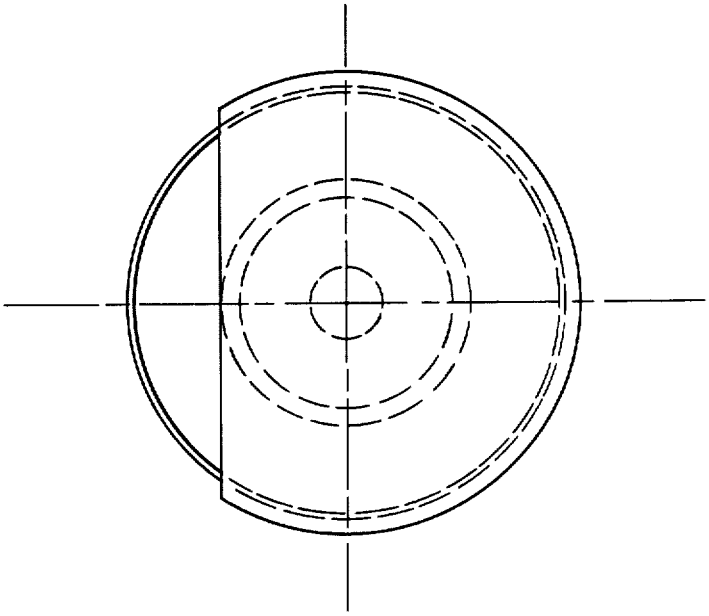
FIG. 2 shows a view from above, in a partial diagrammatic section along the line A—A, of the device according to the invention corresponding to the same embodiment.

As shown in FIGS. 1 and 2, the elastic disk sector 2 has a surface area greater than that of a half sector of a circular disk having the same diameter, such that said elastic disk sector covers the orifice of the container on which the device is fitted or the orifice 4 in said circular crown of inner cap 3.

Furthermore, as shown in FIGS. 1 and 2, the straight edge 5 of elastic disk sector 2 may be situated a priori at any level, within the constraints provided above. Moreover, edge 5 may have any profile in its inner portion between its two extremities delineated by the circumference of the circular disk. Edge 5 is preferably formed by a segment of line which, in practice, is tangential to the internal diameter of the orifice of the container in which the device is used, or, alternatively, to the raised rim portion of the circular crown of inner cap 3.

In accordance with the invention, it is also possible to make an elastic disk sector 2 having more than one edge as described above and shown in FIGS. 1 and 2 as edge 5. For example, an elastic disk sector 2 having two edges that are preferably parallel and diametrically opposed can be used. In still another embodiment, an elastic disk sector 2 having three edges, each of which corresponds to the definition given above for edge 5 and arranged at a 120° angle to each other, can be used.

Those individuals skilled in the art would be able to choose suitable materials for making each of the above-mentioned parts of the present device. For example, the cap 1 with flat crown and depending skirt and the inner cap 3 with circular crown, or that part of the container forming the circular crown surrounding the orifice, can each be made from rigid or semi-rigid plastic materials such as polyethylene, polypropylene, ebonite, metallic or other materials. It is not necessary to construct each of the mentioned parts from the same material. The elastic disk sector 2 may be made of any appropriate elastic material such as expanded polyethylene, natural or synthetic rubber, cork or other material. The elasticity of the material of the elastic disk sector 2 must be able to allow evacuation of the overpressurized gas without notable leaking of the liquid or solid contents of a container fitted with the device according to the invention. As discussed above elastic disk sector 2 of the invention undergoes a partial crushing allowing the opening along edge 5 to be used as an escape zone for the gases.

The dimensions of the different elements of the device can easily be established with routine tests known to those skilled in the art in order to perfect a prototype for each specific application. Common to all applications are the compressibility of the material of elastic disk sector 2 and the ability of the circular crown to allow pressurized gases to escape through edge 5 of elastic disk sector 2.

In order for the evacuated gases to effectively escape into the atmosphere, it is important that cap 1, itself, or a space between cap 1 and the periphery of the orifice of the container closed by gap 1 have appropriate orifices to allow the release of escaping gaes. Preferably, there should be no specific orifice or channel for the evacuation of the gases. The tolerance between the thread of the depending skirt cap 1 of the device and the corresponding thread of the neck of a container should provide the channel for gas escape.

Naturally, the abovementioned invention applies in all fields, subject to necessary adaptations that are within the knowledge of those skilled in the art.

I claim:

1. A valve device for sealing a container having an orifice which provides for automatic venting of gases under pressure formed within the container comprising (a) a cap having a flat crown and depending skirt, (b) a sector of a circular disk composed of an elastic material, said elastic disk sector having an area greater than half the area of an entire circular disk of the same diameter, a straight edge, an upper portion thereof in contact with the underside of the flat crown and, when the device is in use, a flat circular protuberant portion on the underside thereof, said protuberant portion being adjacent the straight edge and having an area less than the area of the elastic disk sector, and (c) an inner cap having a circular crown and depending skirt, said circular crown having a circular cut out portion therein and a raised circular rim portion, said cut out portion being adapted, when the device is in use, to intimately contact the flat circular protuberant portion of the underside of the elastic disk sector, such that the flat circular protuberant portion of the elastic disk sector fits into the cut out portion of the circular crown and is surrounded by the circular rim portion of the circular crown and forms a tight seal therewith, said flat circular protuberant portion of the elastic disk sector and said cut out portion of the circular crown being adapted to be placed vertically over a neck of a container, and said circular crown, which, when the device is in use, exerts a crushing pressure on the elastic disk sector, thereby causing the upper portion of the elastic disk sector to lose elasticity and become pressed against the flat crown whereas, at the same time, the flat circular protuberant portion on the underside of the elastic disk sector which fits into the cut out portion of the circular crown and is surrounded by the raised circular rim portion of the circular crown remains sufficiently elastic to be able to subside to allow the release of excess gas built up in the container, and then reform a tight seal with the raised circular rim portion of the circular crown.

2. A device according to claim 1 in which the circular crown portion comprises the orifice and raised circular crown of the container.

3. A device according to claim 1 wherein the depending skirt of the inner cap inserts into the orifice of the container.

4. A device according to claim 1 wherein the circular crown has an orifice therethrough, said orifice opening at one end into the neck of the container and at the opposite end being covered by the elastic disk sector.

5. A device according to claim 1 wherein the straight edge of the elastic disk sector is tangential to the internal diameter of the container orifice.

6. A device according to claim 1 wherein the straight edge of the elastic disk sector is tangential to the raised zone on the circular crown.

7. A device according to claim 1 which the elastic material of the elastic disk sector is selected from the group consisting of expanded polyethylene, natural rubber, synthetic rubber and cork.

* * * * *

UNITED STATES PATENT AND TRADEMARK OFFICE

CERTIFICATE OF CORRECTION

PATENT NO. : 4,722,450

DATED : February 2, 1988

INVENTOR(S) : Andre Mario

It is certified that error appears in the above-identified patent and that said Letters Patent is hereby corrected as shown below:

Col. 1, line 35, "take" should read --make--;

Col. 2, line 36, "adpated" should read --adapted--;

Col. 2, line 63, "e" should read --the--;

Col. 3, line 61, "gap" should read --cap--;

Col. 3, line 62, "gaes" should read --gases--.

Signed and Sealed this

Fourteenth Day of June, 1988

*Attest:*

DONALD J. QUIGG

*Attesting Officer*

*Commissioner of Patents and Trademarks*